United States Patent [19]

Kolb et al.

[11] 4,047,937

[45] Sept. 13, 1977

[54] METHOD FOR CONTROLLING THE OPERATION OF A STEEL REFINING CONVERTER

[75] Inventors: William A. Kolb, Forest Hills Borough; Pete Vignovich, Bethel Park Borough, both of Pa.

[73] Assignee: United States Steel Corporation, Pittsburgh, Pa.

[21] Appl. No.: 574,838

[22] Filed: May 5, 1975

Related U.S. Application Data

[60] Division of Ser. No. 312,173, Dec. 4, 1972, Pat. No. 3,895,785, which is a continuation-in-part of Ser. No. 277,017, Aug. 1, 1972, abandoned.

[51] Int. Cl.[2] ..... C21C 7/00

[52] U.S. Cl. ..... 75/59; 75/60

[58] Field of Search ..... 75/59, 60, 12, 13; 266/97, 47, 83

[56] References Cited

U.S. PATENT DOCUMENTS

| | | | |
|---|---|---|---|
| 3,725,041 | 4/1973 | Ramachandran | 75/59 |
| 3,843,354 | 10/1974 | Nilles et al. | 75/59 |
| 3,920,447 | 11/1975 | Schroeder et al. | 75/59 |

*Primary Examiner*—M. J. Andrews
*Attorney, Agent, or Firm*—David S. Urey

[57] ABSTRACT

A method for controlling the operation of a steel refining converter of the type having bottom tuyeres, each tuyere consisting of a center jet surrounded by annulus jets is disclosed. Controls are provided for blowing oxygen through the center jets and a fuel gas, such as propane, through the annulus jets during the refining step. Purging gases, such as nitrogen and compressed air, are blown through the jets during other parts of the steel making process. By means of switching circuits, the flow of each selected set of gases is established before the previously selected set can be cut off, one set of gases is automatically substituted for another if there is a loss of pressure at the tuyeres, nitrogen is substituted for oxygen and fuel if the flow of either of the latter two gases falls below a predetermined value and tilting of the converter to an upright position is prevented unless there is adequate pressure in the tuyeres. The disclosed method ensures that molten metal will not enter or damage the tuyeres thereby preventing severe damage to the equipment and possible hazards to operating personnel.

5 Claims, 17 Drawing Figures

FIG. 3
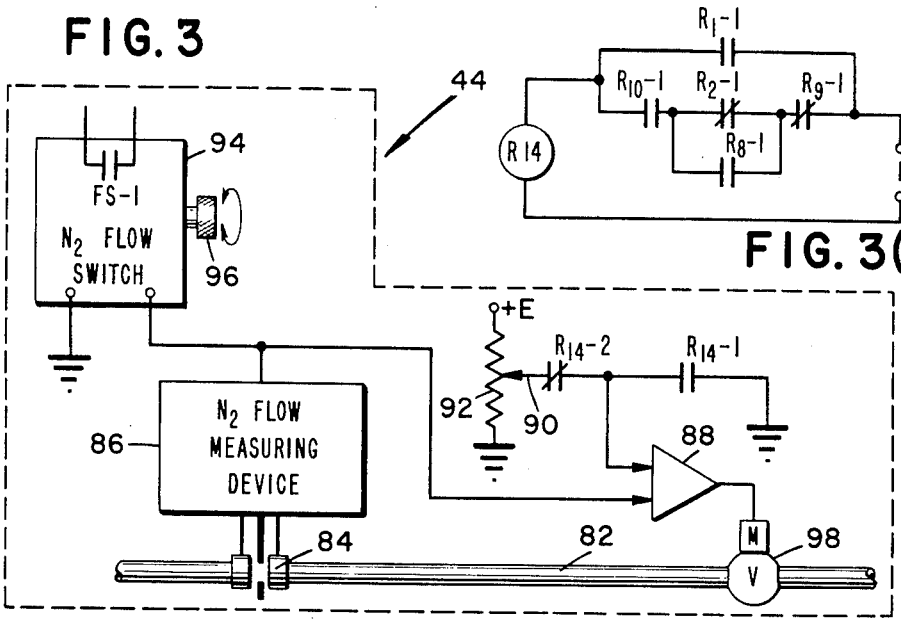
FIG. 3(a)
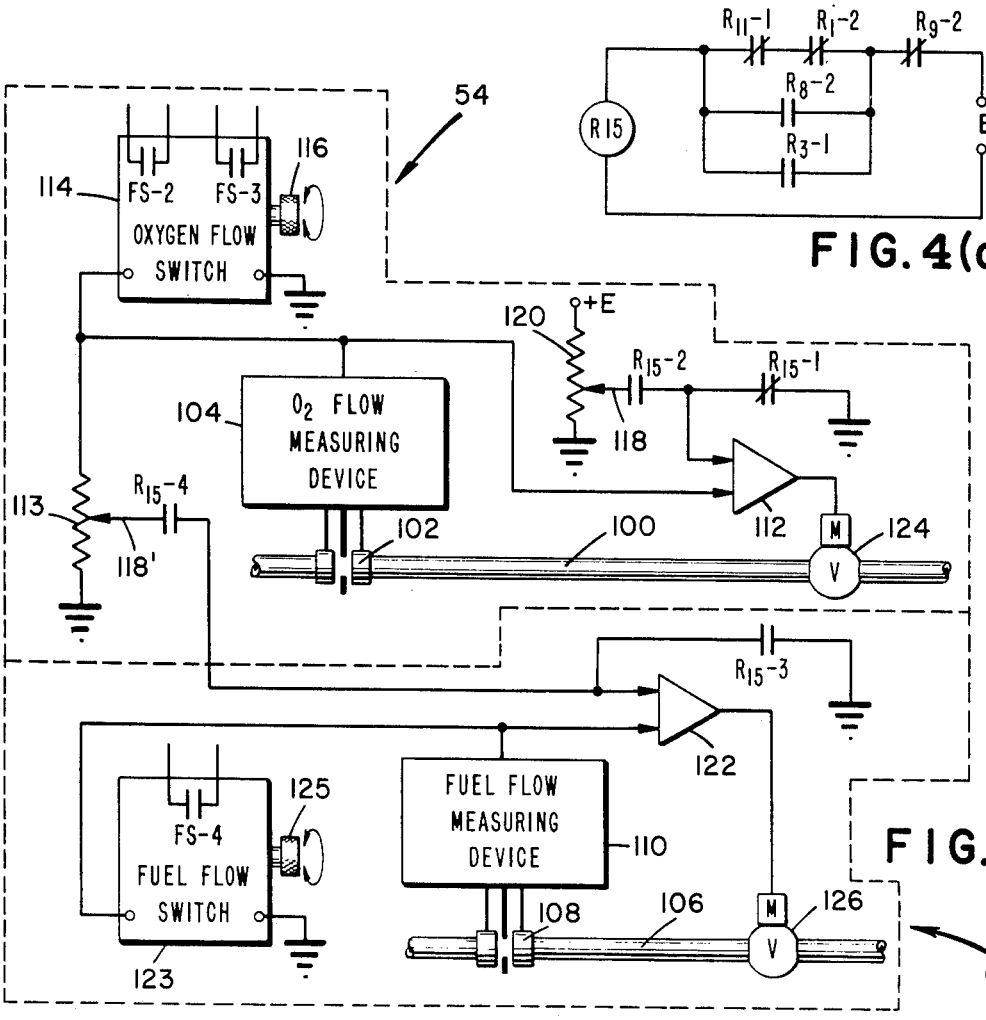
FIG. 4(a)
FIG. 4

FIG. 5
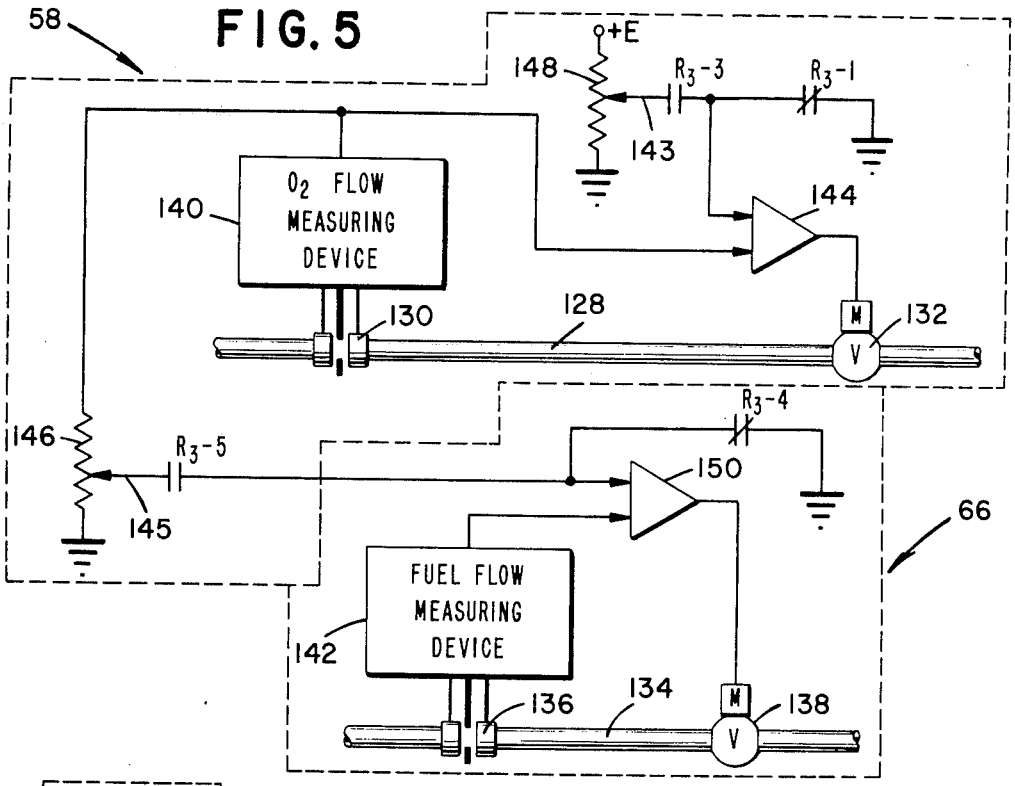
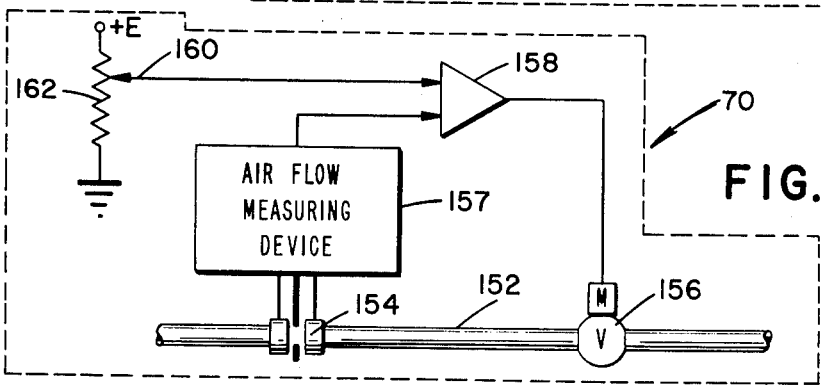
FIG. 6
FIG. 8
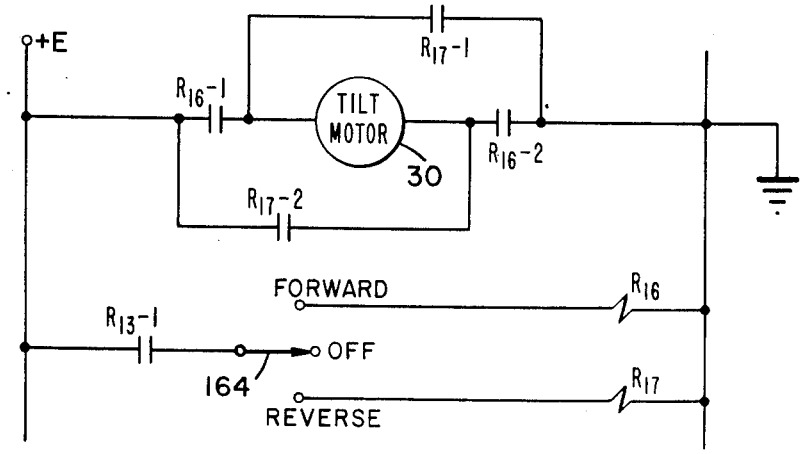

METHOD FOR CONTROLLING THE OPERATION OF A STEEL REFINING CONVERTER

This is a division, of application Ser. No. 312,173, filed Dec. 4, 1972, now U.S. Pat. No. 3,895,785 which is a continuation-in-part of Ser. No. 277,017 filed Aug. 1, 1972, now abandoned.

BACKGROUND OF THE INVENTION

This invention relates to a method for controlling the operation of a steel refining converter and, in particular, to a method for controlling a converter of the type wherein a combination of gases is blown into the melt through tuyeres located at the bottom of the converter.

In a conventional process for refining steel, oxygen is blown into a vessel through a lance positioned above the iron melt. While this process is satisfactory for many purposes the mixing of the batch is not complete enough for some applications, iron losses are relatively high and only a portion of the oxygen issuing from the lance is utilized. An improved process for refining steel employs oxygen blown from below the surface of the melt resulting in better mixing, higher efficiency and less smoke generation than the conventional method. The improved process may also include the use of side tuyeres mounted above the melt as an additional means of introducing oxygen.

A converter employed in carrying out this improved method comprises a tiltable vessel having a refractory lining and a bottom member provided with a plurality of nozzles, or tuyeres, extending through the bottom member. Each tuyere consists of a center jet through which oxygen flows during the refining portion of the process and an annulus jet concentrically surrounding the center jet through which a fuel gas flows to provide cooling for the center jet. Apparatus of this type is disclosed in copending U.S. Patent Application Ser. No. 800,892, filed Feb. 20, 1969, now U.S. Pat. No. 3,706,549 granted on Dec. 19, 1972.

Although oxygen is used in the center jet during the refining operation, various combinations of gases are required for purging, cooling the tuyeres and during other parts of the process such as charging the converter, sampling the resulting melt, tapping the converter after the iron has been refined and during the transition periods when the converter is being rotated to a position in which the next operation can take place. With the converter on its side during the charging, sampling and tapping operations, the tuyeres may be protected by the introduction of purging gases such as compressed air at the center jets and low pressure nitrogen at the annulus jets. When the vessel is being raised to its upright position for the refining operation, the pressure at the jets must be increased to assure that the molten metal will not enter the tuyeres thereby blocking the openings and allowing them to come into contact with the steel and highly corrosive slag. Nitrogen, at a relatively high pressure, may be substituted for the compressed air during this portion of the cycle.

After the converter is in its upright position and located under a hood which carries the gases away, the refining operation is carried out by substituting oxygen for the nitrogen at the center jet and a fuel for the nitrogen at the annulus jet. The pressure during refining must be high enough to prevent the nozzles from becoming blocked or damaged by contact with the melt. When the refining step has been completed, high pressure nitrogen is substituted for the oxygen and the converter tilted downward to permit drawing a sample or removing the completed charge. During the sampling or tapping operations, compressed air or low pressure nitrogen is substituted for the high pressure nitrogen at the center jets in order to prevent contamination of the surrounding area since the mouth of the converter is no longer under the hood.

From this brief description of the bottom-blown process for producing steel, it will be clear that adequate pressure and gas flow must be preserved at the tuyeres whenever they are covered by molten metal so that the metal does not enter the nozzles or connecting gas lines. If this should occur, severe damage would result to the equipment and the resulting conditions might be hazardous to personnel. Accordingly, a control system is highly desirable which will prevent the vessel from being tilted upright unless proper pressure has been provided on the tuyeres and which will assure that adequate pressure and gas flow is maintained on the tuyeres at all times. Further, there must be a smooth transition from one gas to another whenever a change is being made. Such a control system is provided by the present invention.

SUMMARY OF THE INVENTION

In the present invention, apparatus is provided for controlling the operation of a tiltable steel refining converter of the type having at least one tuyere at the bottom consisting of a center jet positioned within an annulus jet. At least first, second and third fluid sources may be coupled to the converter, fluid control means being provided for selectively coupling first and second sets of the fluid sources to the tuyere in response to the setting of a selector switch coupled to the fluid control means by a switching network. For example, in one position of the selector switch the first fluid source may be coupled to both the center and annulus jets to comprise the first set of fluid sources and in another position of the selector switch the second and third fluids may be coupled to the center and annulus jets to comprise the second set of fluid sources.

Means are also provided for detecting if inadequate pressure is present at the center or annulus jet or if the flow rate of any of the fluids is inadequate. In the event the first set of fluids is being supplied to the converter and the pressure at the center or annulus jet falls below a predetermined value, the second and third fluids are substituted in the center and annulus jet respectively. If the flow rate of the first fluid to the center jet decreases below a predetermined value without a reduction in pressure, the second set of fluids is provided to the tuyere together with the first set of fluids. When the second set of fluids is being provided to the tuyere and it is detected that the pressure or flow rates are below a predetermined value, the first set of fluid is substituted in the center and annulus jet.

In the system for providing this control, the first fluid source is coupled to the center jet through a first flow control means and a first valve means and to the annulus jet through a second flow control means and a second valve means. The second fluid source is coupled to the center jet through a third flow control means and a third valve means, and a third fluid source is coupled to the annulus jet through a fourth flow control means and a fourth valve means. Typically, the first fluid may be nitrogen gas, the second fluid oxygen gas and the third fluid selected from the group consisting of natural gas, propane and butane. In addition, a fourth fluid which is coupled to the center jet through a fifth flow control means and a fifth valve means may be provided, the fourth fluid being selected from the group consisting of compressed air, synthetic air (a mixture of nitrogen gas and oxygen gas), nitrogen and argon.

In order to detect whether the pressure at the center or annulus jet is below a predetermined value, first and second pressure measuring means are coupled respectively to these jets. The rate of flow of the first, second, third and fourth fluids is established by flow measuring devices located in the first, third, fourth and fifth flow control means respectively, flow switches being actuated in the first, third and fourth flow control means whenever the flow rate of the corresponding fluids falls below a predetermined value. Means are provided for actuating selectively the appropriate valve means whenever inadequate pressure or flow conditions are detected in order to prevent the melt from entering the tuyeres.

Thus, if the first fluid is being supplied to the center and annulus jets and low pressure at the tuyere is detected, the third and fourth control valves are opened to permit flow of the second and third fluids to the center and annulus jets respectively and to close the first and second valves after a predetermined time delay. Similarly, when the second and third fluids are being supplied to the tuyeres and inadequate pressure or flow is detected, means are provided for opening the first and second valves to permit flow of the first fluid to the center and annulus jets and, after a time delay, close the third and fourth valves thereby stopping the flow of the second and third fluids. The means for coupling the pressure and flow rate measuring devices to the valves is preferably electrical but pneumatic, mechanical, hydraulic or combinations of such may be used.

Selection of the proper combinations of gases through the tuyeres at the various stages of the refining process is provided in a preferred embodiment by a selector switch having first, second and third positions. In the first position, the selector switch is electrically connected to the second and fifth valve means which, when energized, couple the first and fourth fluid sources to the annulus and center jets respectively. In the second position of the switch, the first and second valve means are actuated coupling the first fluid source to the center and annulus jets and in the third position the third and fourth valve means are actuated coupling the second and third fluid sources to the center and annulus jets respectively.

To ensure a smooth transition of fluids when the selector switch is moved from one position to the next, means are provided to maintain flow of a first selected set of fluids until flow of a second selected second set of fluids has been established. Thus, the first set of fluid is shut off only after a predetermined time delay and after adequate flow of the selected fluid to the center jet has been measured. Further, means are provided to prevent tilting of the converter to its uright position in the event the pressure at the center or annulus jets is below a predetermined value. Additional control means are also provided to ensure safe and proper operation of the converter and these will be explained in detail hereinafter.

BRIEF DESCRIPTION OF THE DRAWINGS

FIGS. 3 and 3A show portions of the apparatus for controlling the flow of nitrogen;

FIGS. 4 and 4A illustrate the apparatus for controlling the flow of oxygen and fuel to the bottom tuyeres;

FIG. 5 shows apparatus for controlling the flow of oxygen and fuel to the side tuyeres;

FIG. 6 depicts apparatus for control of the air supply to the bottom tuyeres;

FIG. 8 is a schematic diagram of the motor drive for tilting the converter;

DESCRIPTION OF THE PREFERRED EMBODIMENT

The Refining Process

Figures 1A, 1B, 1C:
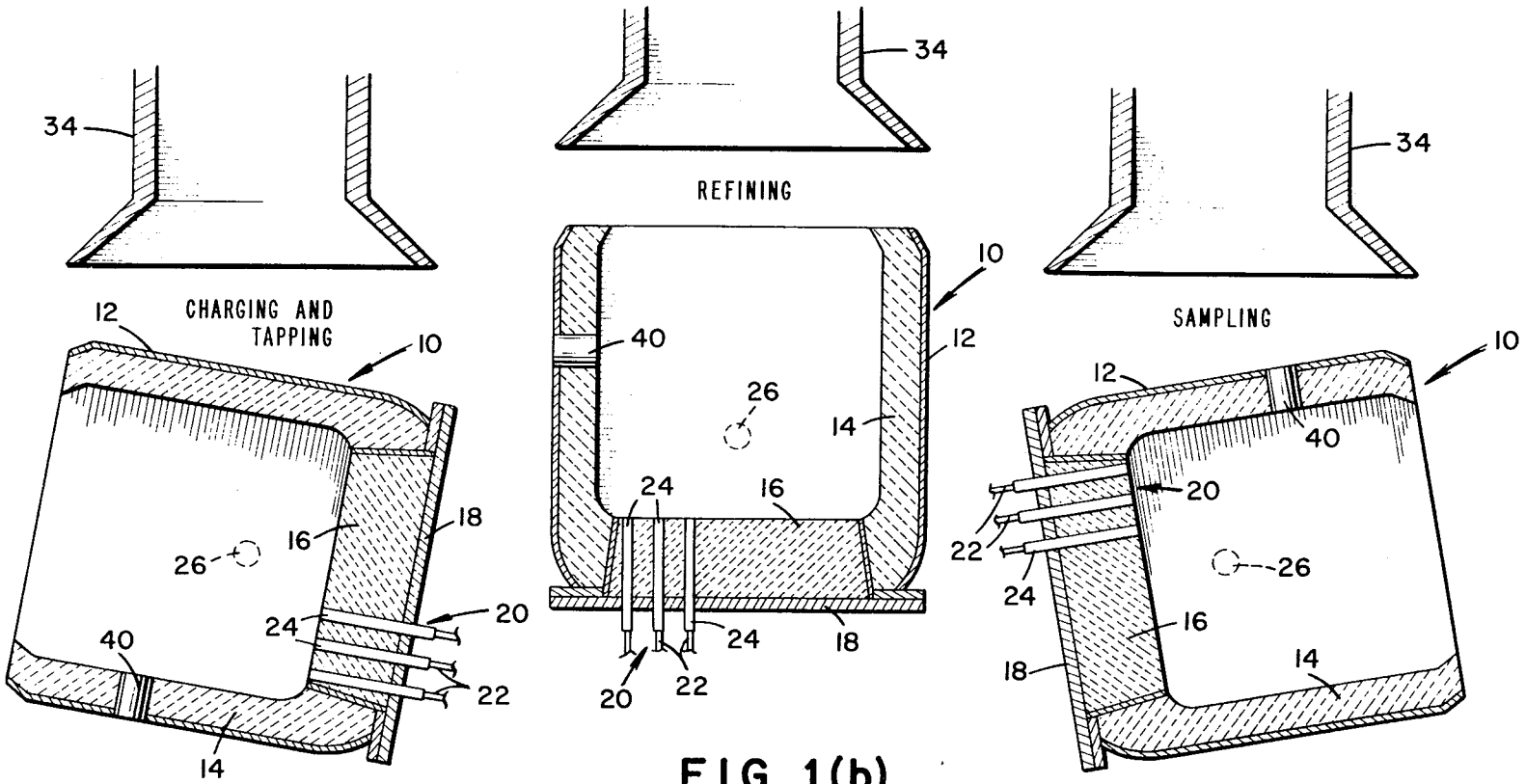
FIGS. 1A–1C are diagrams showing the orientation of the converter for various positions of the selector switch.

Referring to FIGS. 1A, 1B, 1C and 2, a converter 10 is shown oriented for the various operations required in the process of refining pig iron into steel. FIG. 1A shows the position of converter 10 for the charging and tapping operations, FIG. 1B the position of the converter during the actual refining step, and FIG. 1C the converter position during sampling and test of the refined iron. The converter 10 is provided with a steel shell 12 having a brick refractory lining 14 and a refractory bottom plug 16 positioned on a steel bottom plate 18. Bottom tuyeres 20 (FIGS. 1*a*–1*c*, 2), each having a center jet 22 and an annulus jet 24 concentric with and surrounding the center jet 22 are preferably located to one side of the bottom plug 16 and parallel to the axis A — A (FIG. 2) of trunnions 26 about which the converter 10 is tilted. In addition to the bottom tuyeres 20, side tuyeres 28 (FIG. 2) may be provided in the wall of the converter 10 to accelerate conversion of carbon monoxide above the level of the melt to carbon dioxde.

The sequence of steps during a normal refining operation begins with the converter 10 in the orientation shown in FIG. 1*a* and a selector switch 32 (FIG. 7) placed in position A. In position A, compressed air (or low pressure nitrogen) is supplied to the center jets 22 of tuyeres 20 and nitrogen to the annulus jets 24. The pressure of the gases at the center 22 and annulus jets 24 are in the ranges 10 to 20 pounds per square inch and 60 to 90 pounds per square inch respectively. The vessel 10 may be heated by a suitable source (not shown) and a scrap and pig iron charge placed therein while it is in the tilted position shown in FIG. 1*a.*

Selector switch 32 (FIG. 7) is next moved to position B causing nitrogen at a pressure in the range 60 to 110 pounds per square inch to be substituted for the compressed air in the bottom center jet 22 and the converter 10 is rotated about trunnions 26 by a motor 30 (FIG. 8) to the upright position shown in FIG. 1*b* where its mouth is under hood 34. The higher pressure on the center jet 22 prevents the charge from entering and possibly blocking or otherwise damaging the bottom tuyeres 20. Oxygen is not introduced into the converter 10 prior to attaining the upright position of FIG. 1*b* because, when the vessel 10 is on its side and not under hood 34, fumes may be blown into the area surrounding the converter 10 due to the reaction of the oxygen with the melt.

With the converter mouth under hood 34, selector switch 32 (FIG. 7) is moved to position C and pure oxygen substituted for the nitrogen in the bottom center jets 22 and a fuel, such as propane, substituted for the nitrogen in the surrounding annulus jets 24. During the refining step, the fuel acts as an encasing gas to retard melting of bottom tuyeres 20 and premature wear of the converter bottom 16. In this position, oxygen and fuel are also fed to the center jets 36 and annulus jets 38 of the side tuyeres 28.

Upon completion of the refining step, switch 32 (FIG. 7) is moved back to position B replacing the gases in the bottom tuyeres 20 with nitrogen and cutting off the flow of oxygen and fuel to the side tuyeres 28. Converter 10 is then rotated down to the position shown in FIG. 1*c* and switch 32 (FIG. 7) moved to position A substituting lower pressure nitrogen or compressed air for the high pressure nitrogen in the bottom center jets 20. In this position, in which the bottom tuyeres 20 are not usually covered by the melt, the steel is sampled to determine whether refining has been completed. If the test is satisfactory, selector switch 32 (FIG. 7) is moved to position B and the converter 10 rotated to the orientation shown in FIG. 1*a* where the selector switch 32 is turned to position A, plug 40 (FIGS. 1*a*–1*c,* 2) removed from the side of the converter 10 and the steel poured from the vessel 10 through the opening formed by removal of the plug. Alternatively, the steel may be poured over the lip of the vessel. If the test is unsatisfactory, further refining may be carried out by returning the converter to the upright orientation of FIG. 1*b* and then repeating the testing step.

Converter Gas Supply System

Figure 2:
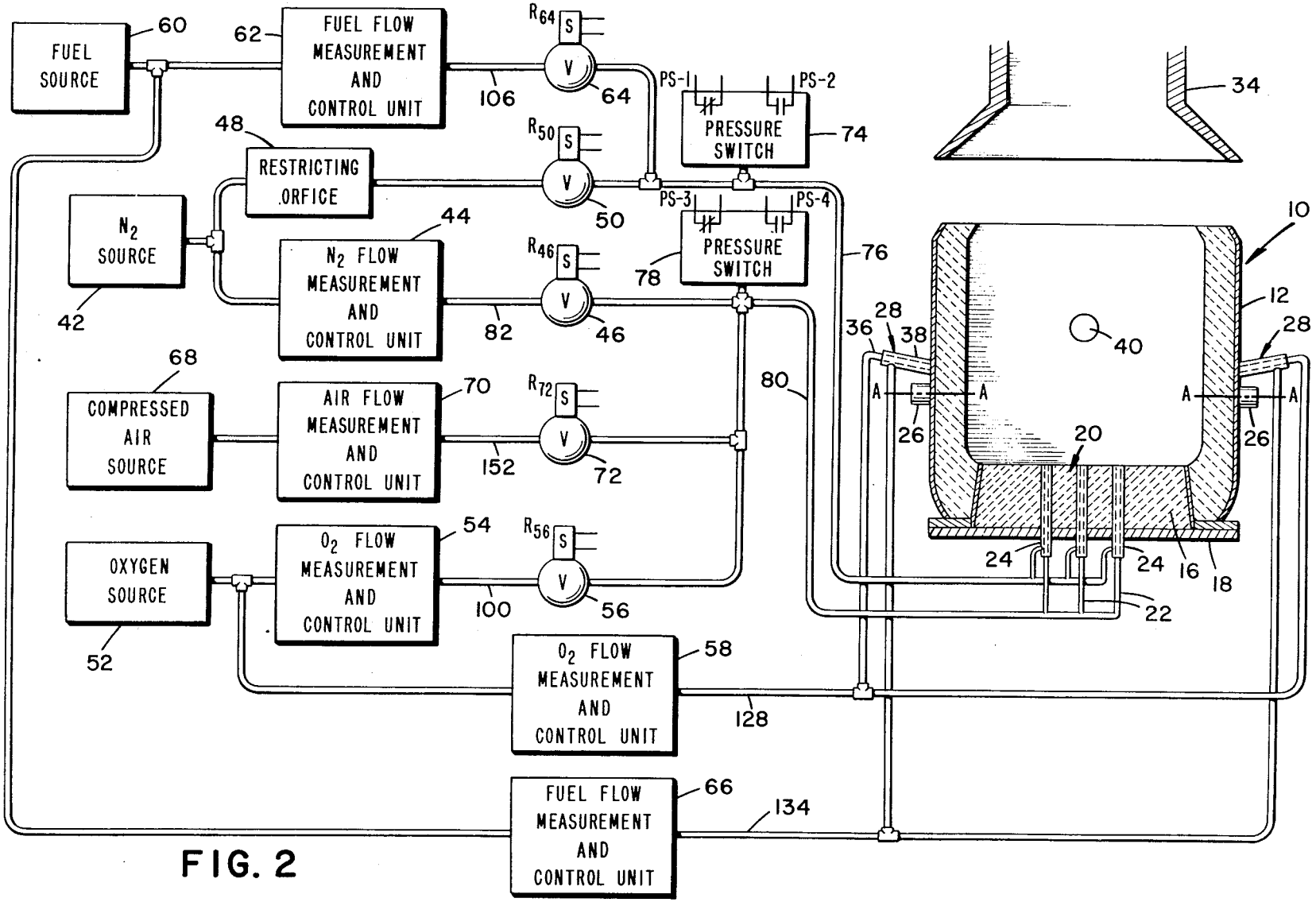
FIG. 2 is a block diagram of the system for controlling the operation of the steel refining converter.

Referring to FIG. 2, a schematic block diagram showing how the various gases used in operation of converter 10 are coupled to the tuyeres 20 and 28 of the converter 10, a nitrogen source 42 is coupled through a nitrogen flow measurement and control unit 44 (FIGS. 2,3) and a valve 46 (FIG. 2) actuated by a solenoid $R_{46}$ (FIGS. 2,7) to the center jets 22 of bottom tuyeres 20. Source 42 is also connected by a restricting orifice 48 (FIG. 2), which acts as a flow control means, and a valve 50 actuated by solenoid $R_{50}$ (FIGS. 2,7) to the annulus jets 24 of bottom tuyeres 20. An oxygen source 52 (FIG. 2) is coupled through a flow measurement and control unit 54 (FIGS. 2,4) and a valve 56 (FIG. 2) actuated by solenoid $R_{56}$ (FIGS. 2,7) to the center jets 22 and also through a flow measurement unit 58 (FIGS. 2,5) to the side tuyeres 28 located in the side of converter 10. A fuel source 60 (FIG. 2) is connected via a fuel flow measurement and control unit 62 (FIGS. 2,4) and valve 64 (FIG. 2) actuated by solenoid $R_{64}$ (FIGS. 2,7) to the bottom annulus jets 24 and through a fuel flow measurement and control unit 66 (FIGS. 2,5) to side tuyeres 28. In addition, a compressed air source 68 (FIG. 2) is coupled through an air flow measurement and control unit 70 (FIGS. 2,6) and solenoid valve 72 (FIG. 2) to the center jets 22 of bottom tuyeres 20. The fuel source 60 may be any fluid that can provide adequate cooling such as propane, natural gas or fuel oil. Further, low pressure nitrogen may be substituted for the compressed air source, if desired.

A pressure switch 74 (FIG. 2) having electrical contacts PS-1 and PS-2 (FIGS. 2,7) is connected to the side annulus jets 24 through piping 76 (FIG. 2), and a pressure switch 78 having contacts PS-3 and PS-4 (FIGS. 2,7) is coupled to the bottom center jets 22 through piping 80. Contacts PS-1 and PS-3 are open under normal pressure but close when the pressure is below a predetermined value. Contacts PS-2 and PS-4 are closed under normal pressure but open when the pressure is below a predetermined value.

The following table summarizes the combinations of gases which may be applied to the center 22 and annulus jets 24 of bottom tuyeres 20.

| Selector Switch (32) Position | Bottom Center Jets (22) | Bottom Annulus Jets (24) |
|---|---|---|
| A | Compressed Air (or low pressure nitrogen) | Nitrogen |
| B | Nitrogen | Nitrogen |
| C | Oxygen | Fuel |

Nitrogen Flow Measurement and Control Unit 44

The nitrogen flow measurement and control unit 44 (FIGS. 2,3) is shown in detail in FIG. 3 wherein cylindrical conduit 82 is a portion of the piping connecting the nitrogen source 42 to solenoid valve 46. Orifice 84 (FIG. 3) is provided at the upstream end of pipe section 82 and a conventional flow measuring unit 86, having a voltage output proportional to the rate of flow of nitrogen through orifice 84, is connected to the orifice 84. Such units are commercially available and, therefore, need not be further described.

The output of flow measuring unit 86 is connected to one input of an amplifier 88 (FIG. 3), the other input of amplifier 88 being connected to ground through a normally open contact $R_{14}$-1 of a relay $R_{14}$ (FIG. 3*a*) and through a normally closed contact $R_{14}$-2 (FIG. 3) of relay $R_{14}$ to the adjustable arm 90 of a potentiometer 92. A normally open contact of a relay shall be defined as a contact which is open when the relay is deenergized and illustrated by two parallel spaced vertical lines and a normally closed contact is one which is closed when the relay is deenergized and is illustrated by two parallel spaced vertical lines with a diagonal line through the parallel lines. The pick up coil of each relay and the relay, per se, shall be designed by the letter "R" and a subscript to identify the relay. Each contact of the relay will be identified by the relay designation followed by a number unique to that contact.

Potentiometer 92 (FIG. 3) is connected between a source of reference potential +E and ground and nitrogen flow switch 94 having a contact FS-1 which is closed when the flow of nitrogen is normal and open when the flow is below a predetermined amount is connected to the output of flow measuring device 86. Flow switch 94 (FIG. 3) is provided with an adjustment knob 96 which may be set to the flow rate at which it is desired that contact FS-1 (FIGS. 3,7) close. The function of flow relay 94 and contact FS-1 will be explained hereinafter. The output of amplifier 88 is connected to motor-operated valve 98 (FIG. 3) which provides a continuous control of the rate of flow of nitrogen through pipe 82 to the center jet 22 of bottom tuyeres 20 in response to the signals at its input.

Relay $R_{14}$

FIG. 3*a* is a control circuit for the operation of relay $R_{14}$. As shown, relay $R_{14}$ is coupled to a source of voltage E through either a first path consisting of a normally open contact $R_1$-1 of a relay $R_1$, (FIG. 7) or a second path comprising in series normally closed contact $R_9$-1 (FIG. 3), normally closed contact $R_2$-1 or normally open contact $R_8$-1, and normally open contact $R_{10}$-1. The operation of this circuit will be described in greater detail in connection with FIG. 7. For present purposes, when relay $R_{14}$ (FIG. 3*a*) is deenergized, the reference potential at the arm 90 (FIG. 3) of potentiometer 92 is compared with the actual flow measurement indicated by the output of flow measuring unit 86. Arm 90 of potentiometer 92 is set to a value corresponding to the desired flow rate of nitrogen to bottom center jets 22 and, when the desired, the actual flow rates are the same, the motor-operated valve 98 (FIG. 3) remains fixed in position. If the operator wishes to change the rate of flow of nitrogen through pipe 82, he adjusts arm 90 on potentiometer 92 to produce a voltage difference between the inputs to amplifier 88 causing valve 98 to open or close thereby changing the rate of flow of nitrogen to jets 22. When relay $R_{14}$ (FIG. 3*a*) is energized an input of amplifier 88 is grounded through contact $R_{14}$-1 (FIG. 3) causing amplifier 88 to drive motor-operated valve 98 to its closed position.

Oxygen Flow Measurement and Control Unit 54 and Fuel Flow Measurement and Control Unit 62 for Bottom Tuyeres 20

FIG. 4 shows details of the oxygen flow measurement and control unit 54 and the fuel flow measurement and control unit 62. In this figure, conduit 100 is a portion of the piping connecting oxygen source 52 and solenoid valve 56. An orifice 102 (FIG. 4) is interposed in the upstream end of conduit 100 and an oxygen flow measuring device 104 coupled to the orifice 102. Analogous to the nitrogen flow measuring device 86, the oxygen flow measuring device 104 generates a voltage having an output which is proportional to the rate of oxygen flow through orifice 102. Similarly, conduit 106 (FIGS. 2,4), which connects fuel source 60 (FIG. 2) to solenoid valve 64 has an orifice 108 connected to fuel flow measuring device 100. As in the case of the nitrogen flow measuring device 86, the oxygen flow measuring device 104 and fuel flow measuring device 110 are conventional.

The output of the oxygen flow measuring device 104 is coupled to one input of an amplifier 112 (FIG. 4), to one end of a potentiometer 113 and to an oxygen flow switch 114 having an adjustment knob 116 and a pair of normally open contacts FS-2 and FS-3 (FIGS. 4,7) which close when the flow rate set by knob 116 is reached. The other input of amplifier 112 (FIG. 4) is connected to ground through a normally closed contact $R_{15}$-1 of a relay $R_{15}$ (FIG. 4*a*) and to the adjustable arm 118 (FIG. 4) of a potentiometer 120 through a normally open contact $R_{15}$-2 of relay $R_{15}$. Similarly, the output of fuel flow measuring device 110 is connected to an input of an amplifier 122 (FIG. 4) and to a fuel flow switch 123 having an adjustment knob 125 and a normally open contact FS-4 (FIGS. 4,7), which closes when the flow rate set by knob 125 is reached. The other input of amplifier 122 is connected to ground through a normally closed contact $R_{15}$-3 (FIG. 4) and to the adjustable arm of potentiometer 113 through normally open contact $R_{15}$-4.

The output of amplifier 112 is connected to a motor-operated valve 126 (FIG. 4) in conduit 100 and the output of amplifier 122 is connected to a motor-operated valve 126 in conduit 106.

Relay $R_{15}$

Relay coil $R_{15}$ (FIG. 4*a*) is connected to the voltage source E through a normally closed contact $R_9$-2 connected in series with a network consisting of series-connected normally closed contact $R_1$-1 and $R_{11}$-1 connected in parallel with normally open contacts $R_8$-2 and $R_3$-1. The purpose of these contacts will be discussed in connection with the schematic control diagram of FIG. 7 but, for the purpose of explaining the operation of the oxygen and fuel flow measurement and control units 54 and 62, it is sufficient to state that relay $R_{15}$ is energized to remove the inputs of amplifiers 112 and 122 (FIG. 4) from ground and connect them to the arms of potentiometers 120 and 113 respectively whenever it is desired that ooxygen and fuel be delivered to tuyeres 20.

In order to provide the proper ratio of oxygen to fuel in the center and annulus jets of bottom tuyeres 20, the adjustable arms 118, 118' of potentiometers 120 and 113 (FIG. 4) are set to provide the desired flow rates. For example, potentiometer 120 may be set to provide a flow of oxygen at the rate of 30,000 – 35,000 cubic feet per minute and potentiometer 113 a flow fuel which is 8% of the oxygen flow rate. If the actual flow rates are different from the potentiometer settings, control valves 124 and 126 (FIG. 4) are actuated to change the flow rates. Thus, the operation of the oxygen and fuel flow measurement and control units 54 and 62 is the same in this respect as the previously described operation of the nitrogen flow measurement and control unit 44.

Oxygen Flow Measurement and Control Unit 58 and Fuel Flow Measurement and Control Unit 66 for Side Tuyeres 28

Referring to FIG. 5, it is seen that the components and operation of the oxygen flow measurement and control unit 58 and fuel flow measurement and control unit 66 which supply oxygen and fuel to the side tuyeres 28 is quite similar to that of units 54 and 62. In oxygen flow measurement and control unit 58, a conduit 128 (FIG. 5) having an orifice 130 in its upstream end and a motor-operated control valve 132 at its downstream end is part of the piping connecting the oxygen source 52 and the center jets 36 of side tuyeres 28. Similarly, conduit 134 (FIG. 5), having an orifice 136 at its upstream end and a motor-operated valve 138 at its downstream end is part of the piping connecting the fuel source 60 with the annulus jets 38 of side tuyeres 28. An oxygen flow measuring device 140 and a fluel flow measuring device 142 are connected to orifices 130 and 136 to provide voltages proportional to the rate of flow of oxygen and fuel respectively through conduits 128 and 134. The output of oxygen flow measuring device 140 (FIG. 5) is coupled to one input of amplifier 144 and to the end of a potentiometer 146 having its other end connected to ground. The other input of amplifier 144 is connected to ground through a normally closed relay contact $R_3$-2 and to the adjustable arm 143 of a potentiometer 148 through a normally open relay contact $R_3$-3 (FIG. 5), potentiometer 148 being connected across the voltage source +E. Similarly, the output of fuel flow measurement device 142 is connected to one input of an amplifier 150, the other input being connected to ground through the normally closed contact $R_3$-4 (FIG. 5) and to an adjustable arm 145 on potentiometer 146 through a normally open contact $R_3$-5. The outputs of amplifiers 144 and 150 (FIG. 5) are connected to valves 132 and 138 respectively, these valves being controlled in the same manner as valves 124 and 126 of FIG. 4. The operation of relay contacts $R_3$-2 to $R_3$-5 will be explained hereinafter in connection with FIG. 7 but, for the purposes of understanding the operation of FIG. 5, it can be stated that the contacts of relay $R_3$ (FIG. 7) are in the position shown in FIG. 5 only when selector switch 32 (FIG. 7) is in position A or B and it is desired that valves 132 and 138 (FIG. 5) be closed to prevent the flow of oxygen or fuel to side tuyeres 28. With switch 32 (FIG. 7) in position C, oxygen and fuel flow to the center jets 36 and annulus jets 38 of side tuyeres 28 at rates determined by the settings of arms 143 and 148 (FIG. 5) of potentiometers 146 and 148 respectively.

Air Flow Measurement and Control Unit 70

The air flow measurement and control unit 70 is illustrated in FIG. 6 wherein conduit 152 having an orifice 154 at its upstream end and a motor-operated control valve 156 at its downstream end is part of the piping connecting compressed air source 68 to solenoid-actuated valve 72. Measurement and control unit 70 (FIG. 6) comprises an air flow measuring device 157 and amplifier 158, the desired rate of air flow in conduit 152 being set by adjusting the arm 160 of a potentiometer 162 connected across the voltage source +E. Arm 160 (FIG. 6) is connected to one input of amplifier 158, the other input of the amplifier being coupled to the output of the air flow measuring device 157 and the output of the amplifier 158 being connected to the motor-operated valve 156. Since amplifier 158 is connected directly to potentiometer 162, valve 156 will be set to provide an air flow through conduit 152 which corresponds to the setting of potentiometer 162.

Control Circuits and Converter System Operation

Figure 7:
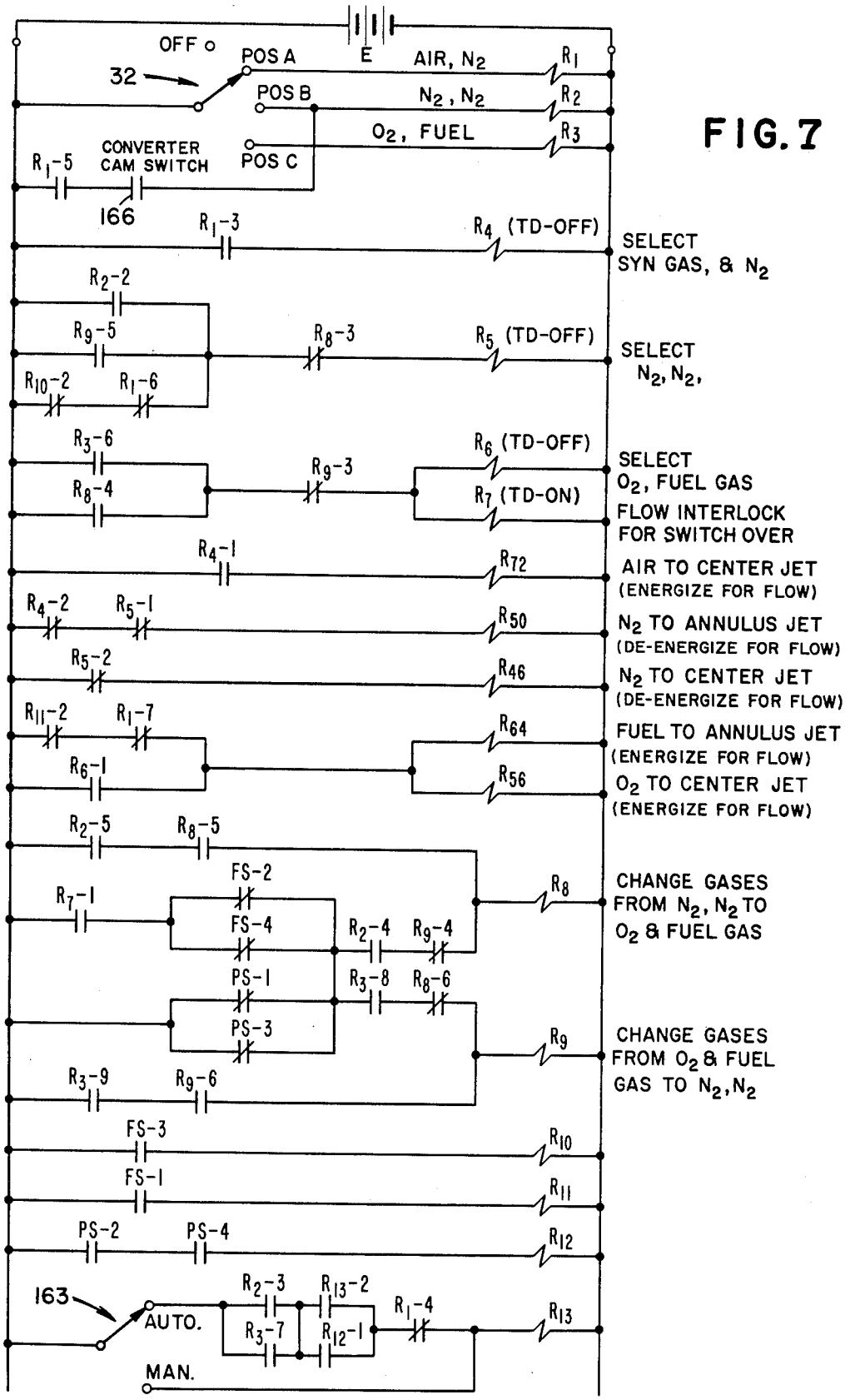
FIG. 7 is a schematic control diagram showing operation of the system.

The detailed operation of the system can be understood from a description of the schematic electrical control diagrams of FIGS. 7 and 8 in connection with the other Figures. Before describing the detailed operation of the system, however, its basic functions will be reviewed. These are:

1. To select the correct combination of gases for each stage of the refining process.
2. To provide a smooth transition when a change of gases is made.
3. To ensure that the converter is never tilted upright without adequate pressure on the bottom tuyeres 20.
4. To assure that adequate pressure is maintained at all times on the bottom tuyeres 20.
5. To protect the tuyeres 20, 28 in the event the flow of oxygen or fuel becomes inadequate.

Functions 1 and 2

The first two functions are accomplished by opening and closing the appropriate solenoid valves 46, 50, 56, 64 and 72 (FIG. 2) and motor-operated valves 98 (FIG. 3), 124, 126 (FIG. 4), 132, 138 (FIG. 5) and 156 (FIG. 6) for each stage of the refining process in accordance with the position of selector swtich 32 (FIG. 7) located physically at the operator's console.

Position A

With selector switch 32 (FIG. 7) in position A, relay coil $R_1$ (FIG. 7) is connected across the voltage source E. Energizing relay $R_1$ (FIG. 7) closes contact $R_1$-3 picking up the coil of relay $R_4$. Relay $R_4$ (FIG. 7) is designed to pick up without intentional delay but, when deenergized, drops out only after a finite predetermined delay as indicated in FIG. 7 by the legend TD-OFF. When relay $R_4$ is energized, contact $R_4$-1 closes causing solenoid $R_{72}$ (FIGS. 2,7) in valve 72 (FIG. 2) to pick up, thus opening valve 72 and permitting compressed air from source 68 to flow to the center jets 22 of bottom tuyeres 20 in accordance with the setting of arm 160 (FIG. 6) on potentiometer 161 of the air flow measurement and control unit 70 (FIG. 6). Simultaneously, contact $R_4$-2 (FIG. 7) is opened, deenergizing solenoid $R_{50}$ (FIGS. 2,7) to open valve 50 (FIG. 2) and permit nitrogen to flow from source 42 through the restricting orifice 48 (FIG. 2) to the bottom annulus jets 24. Solenoid valves 50 and 46 (FIG. 2) open when deenergized (unlike solenoid valves 72, 56 and 64 which are closed when deenergized) to assure that nitrogen will be present at the center and annulus jets of bottom tuyeres 20 in the event there is an electrical power or instrument air failure. Thus, if power should be lost during the refining operation and the fuel and oxygen flow to the bottom tuyeres 20 is cut off by the closing of solenoid valves 56 and 64 (FIG. 2), valves 46 and 50 would immediately open maintaining pressure on bottom tuyeres 20 by substituting nitrogen for the oxygen and fuel.

Motor-operated valve 98 (FIGS. 3,3*a*) in nitrogen flow measurement and control unit 44 is closed when selector switch 32 (FIG. 7) is in position A because relay $R_{14}$ (FIG. 3*a*) is picked up through closed contact $R_1$-1 thereby grounding the amplifier input through contact $R_{14}$-1 (FIG. 3). Motor-operated valves 124 and 126 (FIGS. 4, 4*a*) in oxygen and fuel flow measurement and control units 54 and 62 (FIG. 4) are also closed since the inputs of amplifiers 112 and 122 are grounded through contacts $R_{15}$-2 and $R_{15}$-3 respectively of deenergized relay $R_{15}$ (FIG. 4*a*), relay $R_{15}$ being deenergized because contact $R_1$-2 is open and neither contacts $R_8$-1 or $R_3$-1 are closed.

Position B

When selector switch 32 (FIG. 7) is moved to position B, relay $R_2$ (FIG. 7) is energized closing contact $R_2$-2 and energizing relay $R_5$ through the normally closed contact $R_8$-3 of relay coil $R_8$. Relay $R_5$ (FIG. 7), like relay $R_4$, picks up instantaneously but drops out when deenergized only after a time delay. The energization of coil $R_5$ opens contacts $R_5$-1 and $R_5$-2 (FIG. 7) dropping out solenoids $R_{50}$ and $R_{46}$ (FIGS. 2,7) respectively causing valves 50 and 46 (FIG. 2) to open and permit nitrogen to flow to the annulus 24 and center jets 22 respectively of bottom tuyeres 20. The compressed air from source 68 (FIG. 2) is cut off by the closing, after a delay, of valve 72 upon the opening of contact $R_4$-1 (FIG. 7) due to the deenergization of time delay relay $R_4$ by the opening of contact $R_1$-3.

In the nitrogen flow measurement and control unit 44 (FIG. 3), motor-operated valve 98 is opened by an amount determined by the setting of arm 90 on potentiometer 92 by the dropping out of relay $R_{14}$ (FIG. 3*a*) and the consequent opening of contact $R_{14}$-1 (FIG. 3) and closing of contact $R_{14}$-2. Relay $R_{14}$ (FIG. 3*a*) is deenergized because in position B under normal operation contacts $R_1$-1, $R_2$-1 and $R_8$-1 are open.

Position C

The transfer of selector switch 32 (FIG. 7) from position B to position C closes valves 50 and 46 (FIG. 2) after a delay caused by the opening of contact $R_2$-2 (FIG. 7) and the delayed drop-out of relay $R_5$. Relay coil $R_3$ (FIG. 7) is energized closing contact $R_3$-6 and picking up the coil of relay $R_6$ through the normally closed contact $R_9$-3 of relay $R_9$. Relay $R_6$ (FIG. 7), which like relays $R_4$ and $R_5$ has a delay characteristic on drop-out, closes contact $R_6$-1 picking up solenoids $R_{56}$ and $R_{64}$ (FIGS. 2,7) thereby opening valves 56 and 64 (FIG. 2) to permit oxygen and fuel to flow to annulus jets 24 and center jets 22 of bottom tuyeres 20. A smooth transition from nitrogen to fuel and oxygen is assured because of the overlap in the gases provided by the delayed dropout of relay $R_5$ (FIG. 7) permitting the flow of oxygen and fuel to be established before the flow of nitrogen is cut off.

Under normal operating conditions, motor-operated valve 98 (FIGS. 3, 3*a*) is closed when switch 32 (FIG. 7) is moved to position C because relay $R_{14}$ (FIG. 3*a*) is energized grounding the input to amplifier 88 (FIG. 3) through contact $R_{14}$-1 and disconnecting it from potentiometer 92 by the opening of contact $R_{14}$-2. Relay $R_{14}$ (FIG. 3*a*) is energized because adequate oxygen and fuel flow and pressure are present (this being indicated because contacts $R_9$-1 and $R_{10}$-1 are closed as will be explained hereinafter) and contact $R_2$-1 is closed upon the transfer of switch 32 (FIG. 7) from position B to position C. Further, with selector switch 32 (FIG. 7) in position C, relay $R_{15}$ (FIGS. 4, 4*a*) is energized through contacts $R_9$-2 and $R_3$-1 thereby transferring the inputs of amplifiers 112 and 122 (FIG. 4) from ground to the arm of potentiometers 120 and 113 respectively through contacts $R_{15}$-2 and $R_{15}$-4. Thus, the oxygen and fuel flow will be at a rate determined by the settings of potentiometers 120 and 113.

The selection of gases can only be completed if proper flow conditions that will not damage the equipment are met. If the operator turns the selector switch 32 (FIG. 7) from position A or C to position B and the flow of nitrogen is below a predetermined valve causing contacts FS-1 (FIGS. 3, 7) in the nitrogen flow switch 94 (FIG. 3) to be open, relay $R_{11}$ (FIG. 7) will be deenergized. Accordingly, solenoids $R_{56}$ and $R_{64}$ (FIGS. 2,7) will be energized through contacts $R_{11}$-2 and $R_1$-7 (FIG. 7) opening the oxygen and fuel valves 56 and 64 (FIG. 2) to permit these gases to flow to the bottom tuyeres 20. Relay $R_{15}$ (FIGS. 4, 4*a*) is also energized through contacts $R_{11}$-1, $R_1$-2 and $R_9$-2 (FIG. 4*a*) to open oxygen and fuel valves 124 and 126 (FIG. 4) by connecting the inputs of amplifiers 112 and 122 to potentiometers 120 and 113.

If the operator moves the selector switch 32 (FIG. 7) from position B to position C and the flow of oxygen is below a predetermined valve causing contact FS-3 (FIG. 4) of switch 114 to be open, relay $R_{10}$ (FIG. 7) will be deenergized. Consequently, solenoids $R_{46}$ and $R_{50}$ (FIG. 2) will be deenergized by the opening of contacts $R_5$-1 and $R_5$-2 (FIG. 7) when relay $R_5$ is picked up through contacts $R_{10}$-2, $R_1$-6 and $R_8$-3. Relay $R_{14}$ (FIG. 3*a*) will be deenergized because of the opening of contact $R_{10}$-1 causing valve 98 (FIG. 3) to open to an amount determined by the setting of potentiometer 92 thereby permitting nitrogen to flow through valves 98 (FIG. 3) and 46 (FIG. 2) to the bottom center jets 22 and through valve 50 to the annulus jets 24 of bottom tuyeres 20.

Position B

That is, if nitrogen is called for by moving selector switch 32 (FIG. 4) to position B and the flow is inadequate as indicated by the opening of contact FS-1 (FIG. 3), the oxygen valves 124 (FIG. 4), 56 (FIG. 2) and fuel valves 126 (FIG. 4), 64 (FIG. 2) will remain open if switch 32 (FIG. 7) was previously in position C or will automatically move from closed to open if switch 32 was previously in position A. Similarly, if oxygen and fuel are called for by moving selector switch 32 (FIG. 7) to position C and the oxygen flow is inadequate as indicated by the opening of contact FS-3 (FIG. 4), the nitrogen valves 98 (FIG. 3), 46 (FIG. 2) and 50 will remain open. Thus, both sets of fluids, nitrogen-nitrogen and oxygen-fuel, will be provided to the bottom tuyeres 20 to maintain adequate pressure and prevent molten metal from entering them in the event a low rate of gas flow is detected for the selected gas at the bottom center jets 22.

When proper gas flow is restored, the valves associated with the gases not selected automatically close and the selected valves remain open. For example, if switch 32 (FIG. 7) is in position B and nitrogen flow increases sufficiently to close contact FS-1 (FIG. 3) relay $R_{11}$ (FIG. 7) is energized opening contact $R_{11}$-2 thereby deenergizing solenoids $R_{56}$ and $R_{64}$ (FIG. 2) allowing valves 56 and 64 to close. Also, relay $R_{15}$ (FIG. 4*a*) is deenergized by the opening of contact $R_{11}$-1 thereby grounding the inputs to amplifiers 112 and 122 (FIG. 4) through contacts $R_{15}$-1 and $R_{15}$-3 and causing valves 124 and 126 to close.

Position C

In the same way, if switch 32 (FIG. 7) is in position C and oxygen flow increases sufficiently to close contact FS-3 (FIGS. 4,7), relay $R_{10}$ (FIG. 7) is energized opening contact $R_{10}$-2 thereby deenergizing relay $R_5$ and energizing solenoids $R_{46}$ and $R_{50}$ (FIGS. 2,7) through contacts $R_5$-2 and $R_5$-1 (FIG. 7) allowing valves 46 and 50 (FIG. 2) to close. Relay $R_{14}$ (FIG. 3*a*) is energized by the closing of contact $R_{10}$-1 grounding the input to amplifier 88 (FIG. 3) through contact $R_{14}$-1 and closing valve 98.

Function 3

It is essential that the converter 10 never be tilted to an upright position when it is filled with a molten charge if there is inadequate pressure on the bottom tuyeres 20. (Function 3) This is true, for example, when the converter 10 is tilted to the positions shown in FIGS. 1*a* and 1*c*, selector switch 32 (FIG. 7) is in position A and compressed air is being supplied to the bottom center jets 22.

Tilt Motor Control System

The control system for operating the tilt motor 30 (FIG. 8) to rotate the converter 10 about trunnions 26 is shown at the bottom of FIG. 7 and in FIG. 8. It comprises an AUTO-MANUAL switch 163 (FIG. 7) which energizes a relay coil $R_{13}$ (FIG. 7) having a contact $R_{13}$-1 (FIG. 8) in series with a FORWARD-OFF-REVERSE switch 164. A relay coil $R_{16}$ (FIG. 8), having a contact $R_{16}$-1 connected between the positive terminal of the voltage source and tilt motor 30 and a contact $R_{16}$-2 between the grounded terminal of the voltage source and motor 30, is coupled to the FORWARD position of switch 164. A relay coil $R_{17}$ (FIG. 8) having a contact $R_{17}$-1 connected between the junction of contact $R_{16}$-1 and motor 30 and ground and a contact $R_{17}$-2 connected between the junction of contact $R_{16}$-2 and motor 30 and the positive sides of the voltage source, is coupled to the REVERSE position of switch 164. When switch 163 (FIG. 7) is in the MANUAL position relay $R_{13}$ is energized and the tilt motor 30 operated in the forward direction by turning switch 164 (FIG. 8) to FORWARD thereby energizing relay $R_{16}$ and contacts $R_{16}$-1 and $R_{16}$-2. The forward direction of converter motion may be defined as rotation from the orientation shown in FIGS. 1*a*-1*c*, for example. To reverse the direction of converter tilt, switch 164 (FIG. 8) is placed in the REVERSE position thereby energizing relay $R_{17}$ and closing contacts $R_{17}$-1 and $R_{17}$-2 to reverse the polarity of the voltage across the tilt motor 30 from that which is applied in the FORWARD position of switch 164. The MANUAL position of switch 163 (FIG. 7) is used only when the converter 10 is being prepared for the refining operation and there is no molten charge in the vessel. Thus, for normal operation switch 163 (FIG. 7) is is kept in the AUTO position.

The converter 10 must never be tilted upright when selector switch 32 (FIG. 7) is in position A and there is a molten charge in the vessel 10 since the compressed air being fed to the center jets 22 of the bottom tuyeres 20 is at reduced pressure. Accordingly, a normally closed contact $R_1$-4 (FIG. 7) if relay $R_1$ is connected in series with coil $R_{13}$ when switch 163 is in the AUTO position thereby preventing operation of the tilt motor 30 (FIG. 8) when selector switch 32 (FIG. 7) is in position A. When switch 32 (FIG. 7) is moved to position B, sufficient pressure must be applied from nitrogen source 42 to the center 22 and annulus jets 24 of bottom tuyeres 20 to permit the converter 10 to be moved to an upright position (FIG. 1*b*). In order to assure that sufficient pressure is actually applied before the converter 10 is tilted, contacts PS-2 and PS-4 (FIGS. 2,7) of pressure switches 74 and 78 (FIG. 2) are connected in series with a relay coil $R_{12}$ (FIG. 7). Contacts PS-2 and PS-4 (FIGS. 2,7) close only when the pressure required for converter operation in the upright position of FIG. 1*b* is present at the annulus 24 and center jets 22 respectively of bottom tuyeres 20 and, therefore, relay $R_{12}$ (FIG. 7) is energized only under these conditions. When relay $R_{12}$ (FIG. 7) is picked up, contact $R_{12}$-1 closs energizing coil $R_{13}$ through the closed contact $R_2$-3 of relay $R_2$.

Contact $R_{13}$-2 (FIG. 7) of relay $R_{13}$ also closes preventing relay $R_{13}$ from dropping out in the event the pressure should subsequently decrease at the bottom tuyeres 20 thereby deenergizing relay $R_{12}$. This is essential since it would be necessary to quickly tilt the converter 10 onto its side if pressure were lost at the bottom tuyeres 20, and it is desirable that this be possible without moving switch 163 (FIG. 7) to the MANUAL position. Also, contact $R_3$-7 (FIG. 7) is connected in parallel with contact $R_2$-3 to permit lowering of the converter 10 when switch 32 (FIG. 7) is in position C.

Function 4

The fourth function, that of making certain that adequate pressure is maintained on the bottom tuyeres 20 at all times, is provided by circuits which automatically connect nitrogen to the center 22 and annulus jets 24 if fuel and oxygen are being used and the pressure of one of these should drop below a predetermined value. Further, the circuits automatically connect fuel to the annulus jet 24 and oxygen to the center jet 22 if nitrogen is being used and the pressure at either the annulus 24 or center jets 22 drops below a predetermined value.

Assume that selector switch 32 (FIG. 7) is in position B energizing relay $R_2$ (FIG. 7) and that nitrogen is being supplied to the annulus 24 and center jets 22 of bottom tuyeres 20. If now, the pressure on the bottom tuyeres 20 should drop below a predetermined value, one or both of contacts PS-1 and PS-3 (FIGS. 2,7) in pressure switches 74 and 78 (FIG. 2) respectively will close. As a result, relay $R_8$ (FIG. 7) will pick up through the closed contact $R_2$-4 of relay $R_2$ and the normally closed contact $R_9$-4 of relay $R_9$. The energization of relay $R_8$ (FIG. 7) closes contact $R_8$-4 energizing relay $R_6$ through contact $R_9$-3 causing the oxygen and fuel solenoids $R_{56}$ and $R_{64}$ (FIGS. 2,7) to pick up through contact $R_6$-1 (FIG. 7) to supply these gases to the bottom tuyeres 20. Contact $R_8$-3 (FIG. 7) also opens, shutting off the supply of nitrogen after a time delay by closing solenoids $R_{50}$ and $R_{46}$ (FIGS. 2,7) as previously explained. This is advisable since the drop in pressure may have been caused by a leak in the nitrogen supply or piping. Relay $R_8$ (FIG. 7) is sealed in through contacts $R_8$-5 and $R_2$-5 to prevent the system from switching back automatically to nitrogen after operating pressure is restored by the substitution of the fuel and oxygen sources 60 and 52 (FIG. 7) for the nitrogen source 42. The circuit may be reset by turning selector switch 32 (FIG. 7) to position C thereby dropping out relay $R_8$ (FIG. 7) while maintaining flow of oxygen and nitrogen to bottom tuyeres 20.

Valves 124 and 126 (FIG. 4) in the oxygen and fuel flow measurement and control units 54 and 62 are opened by the energization of relay $R_{15}$ (FIG. 4*a*) which couples the inputs of amplifiers 112 and 122 (FIG. 4) to potentiometers 120 and 113 through contacts $R_{15}$-2 and $R_{15}$-4. Relay $R_{15}$ (FIG. 4*a*) is energized through contacts $R_9$-2 and $R_8$-2 and remains energized when the circuit is reset by turning switch 32 (FIG. 7) to position C through contact $R_3$-1 (FIG. 4). Valve 98 (FIG. 3) in the nitrogen flow measurement and control unit 44 is closed by the energization of relay $R_{14}$ (FIG. 3*a*) through contacts $R_9$-1, $R_8$-1 and $R_{10}$-1 (indicating adequate oxygen flow) and through contacts $R_9$-1, $R_2$-1 and $R_{10}$-1 after switch 32 (FIG. 7) has been moved to position C.

If, on the other hand, selector switch 32 (FIG. 7) is in position C, oxygen and fuel are being supplied to the bottom tuyeres 20 and one or both the contacts PS-1 and PS-3 (FIGS. 2,7) closes, relay $R_9$ (FIG. 7) will be picked up through contact $R_3$-8 of relay $R_3$ and contact $R_8$-6 of relay $R_8$. Energization of relay $R_9$ (FIG. 7) causes contact $R_9$-5 to close, picking up relay $R_5$ which, results in the deenergization of solenoids $R_{46}$ and $R_{50}$ (FIGS. 2,7) thereby connecting nitrogen sorce 42 (FIG. 2) to the bottom tuyeres 20. Contact $R_9$-3 (FIG. 7) also opens deenergizing relay $R_6$ after a time delay thereby shutting off the fuel and oxygen valves 64 and 56 (FIG. 2) and preventing a leak in the fuel or oxygen system from further decreasing the pressure. Relay $R_9$ (FIG. 7) is sealed in through contacts $R_9$-6 and $R_3$-9 to prevent the system from automatically switching back to oxygen and fuel after operating pressure has been restored by the substitution of nitrogen source 42 (FIG. 2) for the oxygen and fuel sources 60 and 52. Als, contacts $R_8$-6 and $R_9$-4 (FIG. 7) prevent either relay $R_8$ or $R_9$ from being energized if the other relay has been picked up. The circuit may be reset by turning selector switch 32 (FIG. 7) to position B thereby dropping out relay $R_9$ while maintaining flow of nitrogen to bottom tuyeres 20.

Valve 98 (FIG. 3) in the nitrogen flow measurement and control unit 44 is opened by the deenergization of relay $R_{14}$ (FIG. 3*a*) when contact $R_9$-1 opens thereby connecting the input of amplifier 88 (FIG. 3) to potentiometer 92. Relay $R_{14}$ (FIG. 3a) remains deenergized after the circuit is reset by the opening of contact $R_2$-1. Valves 124 and 126 (FIG. 4) in the oxygen and fuel flow measurement and control units 54 and 62 are closed, as previously described, by the deenergization of relay $R_{15}$ (FIG. 4a) when contact $R_9$-2 opens. Relay $R_{15}$ (FIG. 4a) remains deenergized and valves 124 and 126 (FIG. 4) remain closed after the circuit has been reset by moving switch 32 (FIG. 7) to position B because contacts $R_1$-2, $R_8$-2 and $R_3$-1 (FIG. 4a) are all open. After adequate pressure has been restored, the system may be returned to the desired gas set by returning selector switch 32 (FIG. 7) to the appropriate position.

Function 5

Damage may be caused to the bottom tuyeres 20 when oxygen and fuel are being delivered, even though the pressure is adequate, if the oxygen or fuel flow rates should drop below values which will permit burning of the bottom annulus 24 and center jets 22. In this event, (Function 5) the system automatically switches to nitrogen in bottom tuyeres 20 until the vessel 10 can be tilted and the condition corrected. Assume that selector switch 32 (FIG. 7) is in position C thereby causing relays $R_3$, $R_6$, $R_7$ (FIG. 7) and solenoids $R_{56}$ and $R_{64}$ (FIGS. 2,7) to be energized. If the flow rate of either the oxygen, fuel or both should drop below a predetermined value, one or both of the contacts FS-2 (FIGS. 4,7) in oxygen flow switch 114 (FIG. 4) and FS-4 (FIGS. 4,7) in fuel flow switch 123 (FIG. 4) will close. This causes relay $R_9$ (FIG. 7) to pick up through contacts $R_7$-1 of relay $R_7$, $R_3$-8 and $R_8$-6, to close contact $R_9$-5 to pick up relay $R_5$ and to open valves 50 and 46 (FIG. 2) to permit nitrogen to flow to the annulus 24 and center jets 22 of bottom tuyeres 20. Simultaneously, contact $R_9$-3 (FIG. 7) is opened deenergizing relay $R_6$ after a time delay and causing valves 56 and 64 (FIG. 2) to close shutting off the supply of oxygen and fuel to bottom tuyeres 20. Relay $R_9$ (FIG. 7) seals in through contacts $R_3$-9 and $R_9$-6 and remains energized until selector switch 32 (FIG. 7) is moved to position B corresponding to nitrogen flow to the bottom tuyeres 20. Relay $R_7$ (FIG. 7) has a delay characteristic which permits it to be energized only after a predetermined interval has elapsed. This is to prevent energization of relay $R_9$ (FIG. 7) when switch 32 (FIG. 7) is first moved to position C and there has been insufficient time for the flow of oxygen and fuel to be established.

Further protection is provided by a cam switch 166 (FIG. 7) on converter 10 which closes when the converter 10 is intermediate the position shown in FIGS. 1A and 1C. Switch 166 (FIG. 7) is connected in series with contact $R_1$-5 of relay $R_1$ to energize relay $R_2$ in the event the converter 10 is upright (FIG. 1B) and switch 32 (FIG. 7) is moved to position A. In such event, solenoid $R_{46}$ (FIGS. 2,7) would be deenergized opening valve 46 (FIG. 2) to add nitrogen to the compressed air supplied through valve 72 in position A and thereby provide sufficient pressure at the bottom center jets 22 to prevent the molten metal from entering the bottom tuyeres 20.

ALTERNATIVE EMBODIMENTS

Figure 9:
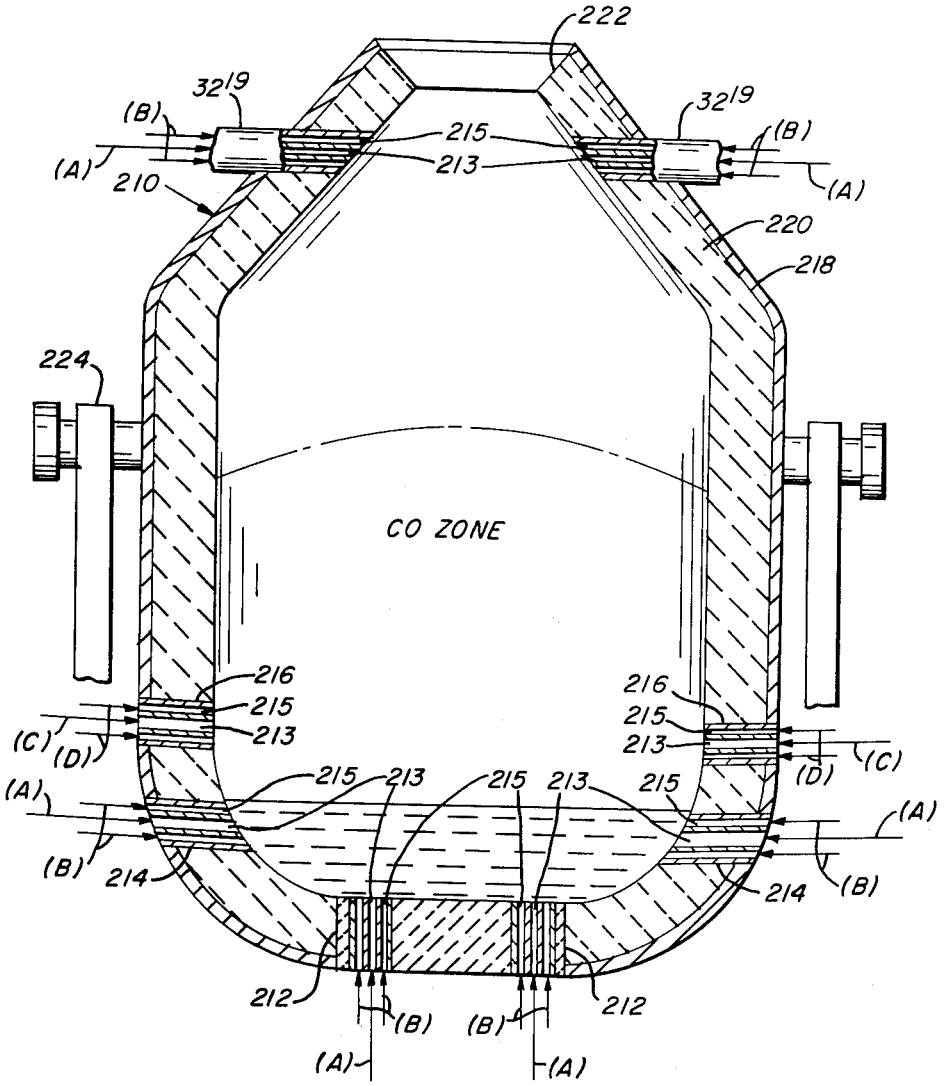
FIG. 9 is a vertical sectional view of a bottom blown oxygen converter showing a pair of submerged bottom tuyeres, a pair of side submerged tuyeres, and a pair of side tuyeres directed toward the carbon monoxide zone of the furnace.

From a consideration of FIG. 9, it will be apparent that the present invention may be employed with a bottom blown converter 210 having bottom submerged tuyeres 212, the side submerged tuyeres 214 and side tuyeres 216 directed toward the carbon monoxide zone (CO zone) of the converter 210. This bottom blown converter 210 has a shell 218 provided with a refractory lining 220 and a mouth 222 and is rotatable on trunions 224. The tuyeres 212, 214, 216 are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), and in an outer pipe 215 a shroud gas, such as propane, natural gas, light fuel oil or the like.

Figure 10:
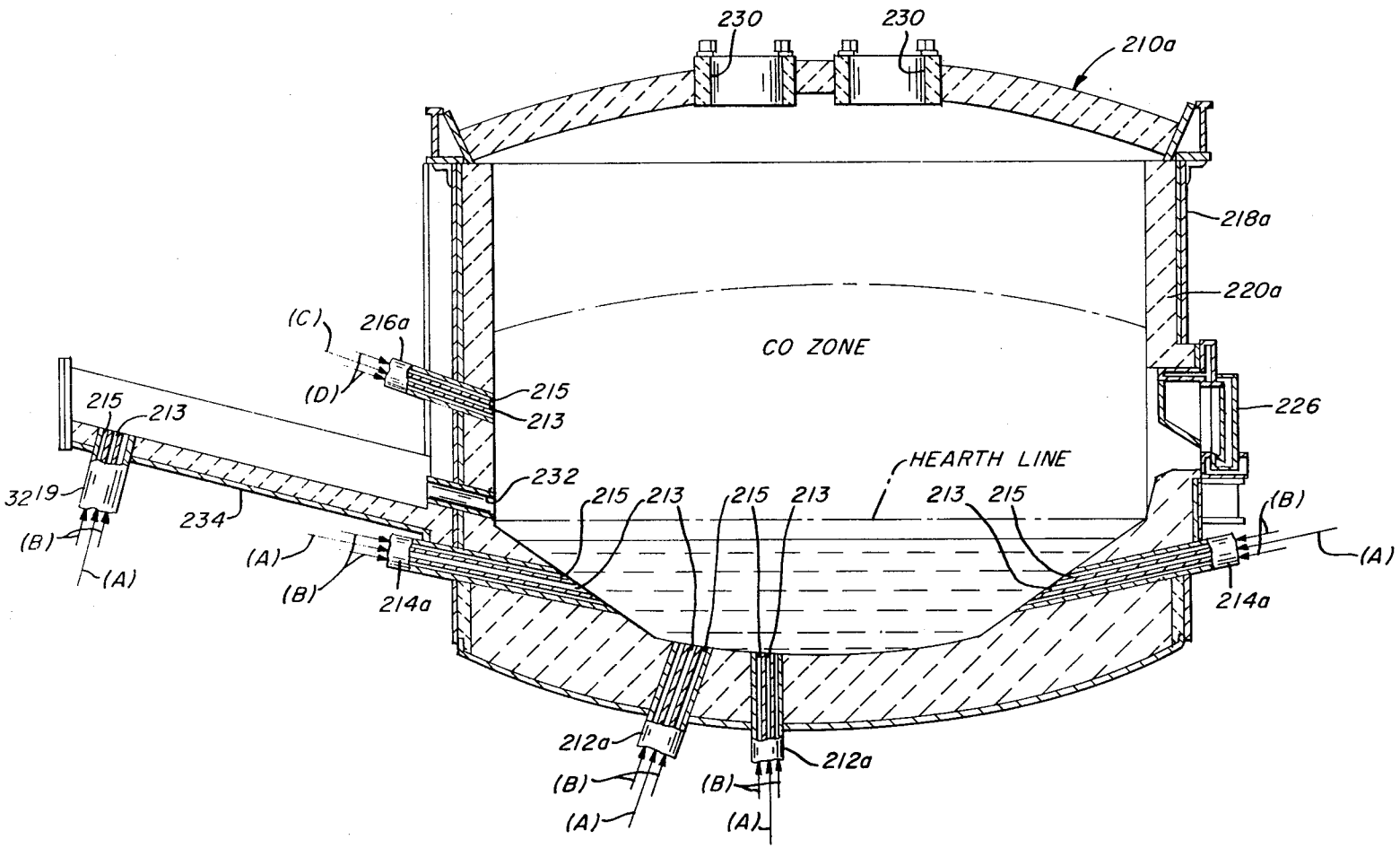
FIG. 10 is a vertical sectional view of an electric-arc steelmaking furnace showing a bottom vertical and bottom inclined submerged tuyere, a pair of side submerged tuyeres and a side tuyere directed toward the carbon monoxide zone of the furnace.

As shown in FIG. 10, the present invention is also applicable to a Heroult Type electric-arc steelmaking furnace 210*a* provided with a vertical and inclined bottom submerged tuyere 212*a* and 212*a*', side submerged tuyeres 214*a*, and a side tuyere 216*a* directed toward the carbon monoxide zone (CO zone) of the furnace 210*a*. This electric arc steelmaking furnace 210*a* has a shell 218*a* provided with a refractory lining 220*a*, a side door 226, a refractory roof 228 provided with electrode holes 230, a tap hole 232, and a pouring spout 234 extending from the tap hole 232. The tuyeres 212 and 212*a*', 214*a*, 216*a* are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro manganese or the like), and in an outer pipe 215, a shroud gas, such as propane, natural gas, light fuel oil or the like.

Figure 11:
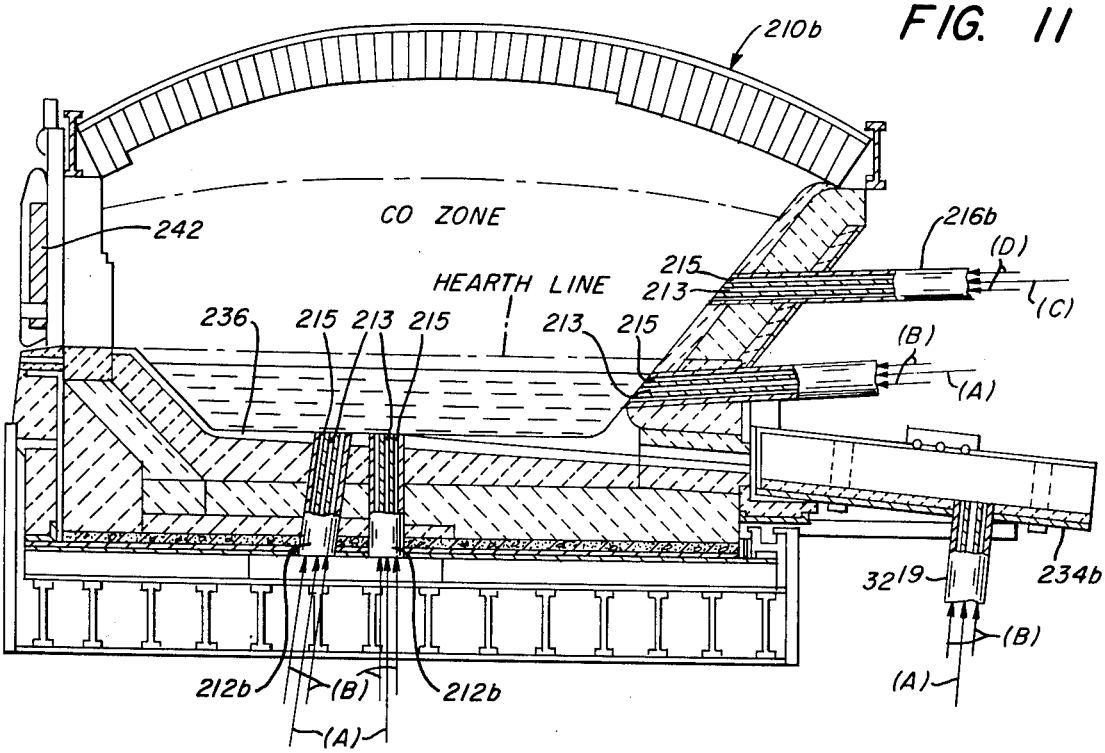
FIG. 11 is a vertical sectional view of an open hearth furnace utilizing a vertical and inclined bottom submerged tuyere, a side submerged tuyere and another side tuyere directed toward the carbon monoxide zone of the furnace.

In addition, the present invention may be employed as shown in FIG. 11 with the open hearth furnace 210*b* having the vertical and inclined bottom submerged tuyeres 212*b* and 212*b*', the side submerged tuyere 214*b*, and the side tuyere 216*b* directed toward the carbon monoxide zone (CO zone) of the furnace 210*b*. This open hearth furnace 210*b* includes a refractory lined bottom 236, a refractory lined sloping back wall 238, a refractory lined front wall 240, a charging door 242 in the wall 240, and a refractory lined roof 244. A tap hole **232*b* opposite the charging door 242 leads to a pouring spout 234*b*. The tuyeres 212*b*, 212*b'*, 214*b*, 216*b*, are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro manganese or the like) and in an outer pipe 215**, a shroud gas, such as propane, natural gas, light fuel oil or the like.

Figure 12:
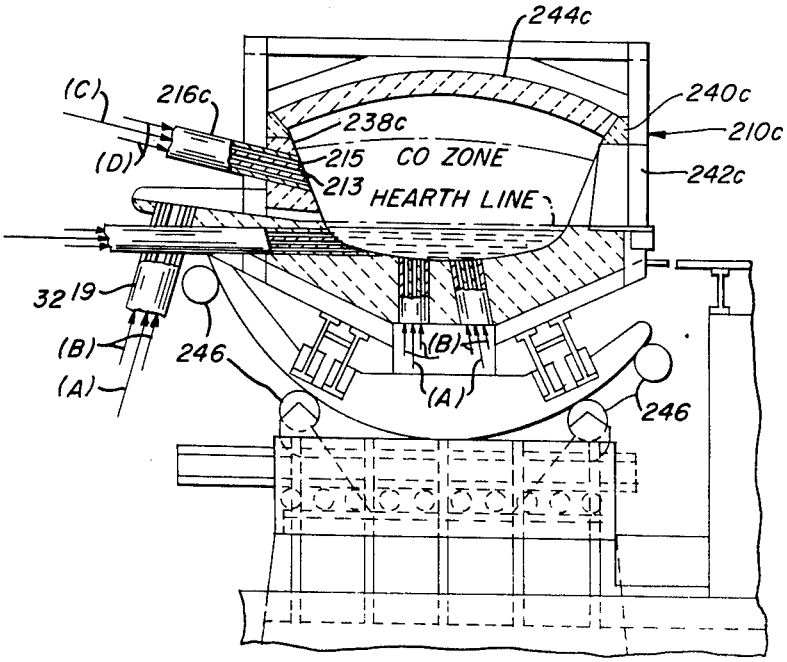
FIG. 12 is a vertical sectional view of a tiltable open hearth furnace having a vertical and an inclined bottom submerged tuyere, a side submerged tuyere and side tuyere directed toward the carbon monoxide zone of the furnace.

Again as shown in FIG. 12, the present invention may be employed with a tilting open hearth furnace **210*c* mounted on rollers 246 arranged in a circular path for providing rotation on the longitudinal axis of the furnace 210*c* for pouring the refined steel through a tap hole 232*c* and a pouring spout 234*c*. As shown in FIG. 12, the tiltable open hearth furnace 210*c* has vertical and inclined bottom submerged tuyeres 212*c* and 212*C'* connected through a blast box 248 to the lines 76 and 80 shown in FIG. 2. In addition, a submerged side tuyere 214*c* and a side tuyere 216*c* directed toward the carbon monoxide zone (CO zone) of the furnace 210*c* are employed. The tiltable open hearth furnace 210*c* has a refractory lined bottom 236*c*, refractory lined back wall 238*c*, refractory lined front wall 204*c* (provided with a charging door 242*c*) and a refractory lined roof 244*c*. The tuyeres 212*c*, 212*c'*, 214*c*, 216*c* are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro mangangese or the like), and in an outer pipe 215**, a shroud gas, such as propane, natural gas, light fuel oil or the like.

Figure 13:
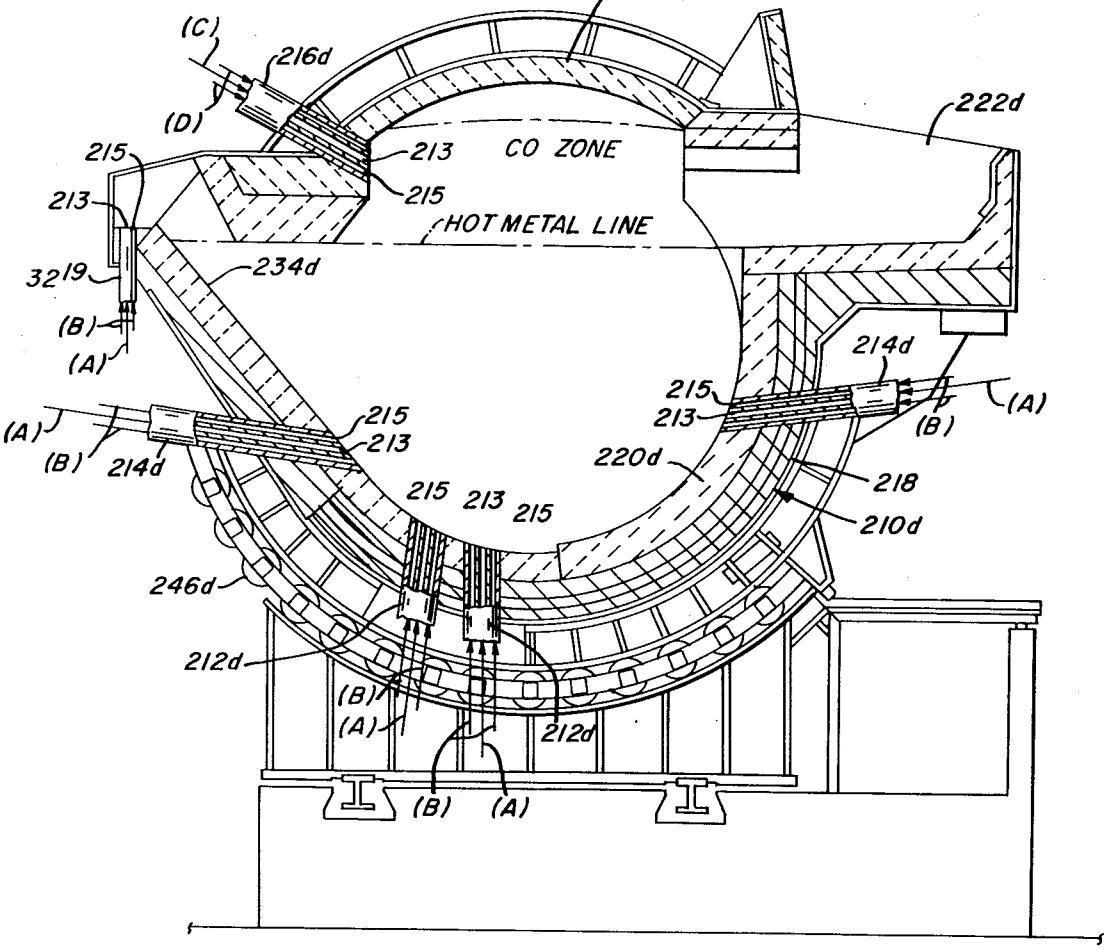
FIG. 13 is a vertical sectional view of oscillatable hot metal mixer having an inclined bottom and vertical bottom submerged tuyeres, a pair of side submerged tuyeres and a side tuyere directed toward the carbon monoxide zone of the mixer.

In FIG. 13, the present invention is employed with a hot metal mixer **210*d* having a shell 218*d* provided with a refractory lining 220*d*, and having also an inlet mouth 222*d* and a pouring spout 234*d*. The mixer 210*d* is oscillatable on rollers 246*d* between the charging and discharging positions. Such mixer 210*d* has vertical and inclined bottom submerged tuyeres 212*d*, 212*d'*, side submerged tuyeres 214*d* and side tuyere 216*d* directed toward the carbon monoxide zone (CO zone) of the mixer 210*d*. The tuyeres 212*d*, 212*d'*, 214*d*, 216*d* are adapted to carry in an inner pipe 213 either a fluid alone, such as oxygen, air, argon, or mixtures thereof, or entrained pulverized additives therein, such as a fluxing agent (burned lime (CaO) or the like), a liquefying agent (fluorspar ($CaF_2$) or the like), or a blocking or deoxidizing agent (ferro manganese or the like), and in an outer pipe 215**, a shroud gas, such as propane, natural gas, light fuel oil or the like.

A discharge tuyere or tuyeres $32^{19}$ (FIGS. 9,10,11,12,13) is disposed adjacent a discharge opening such as the mouth 222 (FIG. 9); the pouring spouts 234 (FIG. 10); **234*b* (FIG. 11); 234*c* (FIG. 12); and 234*d* (FIG. 13**) to prevent the formation of skulls adjacent or on the discharge opening during the pouring operation particularly those chromium-nickel skulls produced during the refining of stainless steel.

What is claimed is:

1. The method of operating a tiltable steel refining converter of the type having at least one tuyere therein positioned below the molten metal level in the converter, said tuyere consisting of a center jet positioned within an annulus jet, comprising the steps of a. tilting said converter onto its side,
b. blowing first and second purging gases at a predetermined pressure through the center and annulus jets of said tuyere respectively,
c. placing a charge within said converter,
d. increasing the pressure of the purging gases being blown through said center jets,
e. tilting said converter to an upright position,
f. blowing oxygen and a fuel through said center and annulus jets respectively while continuing to blow said first and second purging gases through said jets,
g. shutting off said first and second purging gases from the jets of said tuyere once the flow of oxygen and fuel has been established until the refining of said charge is completed,
h. blowing said first and second purging gases through said center and annulus jets while continuing to blow oxygen and fuel through said center and annulus jets respectively,
i. shutting off the oxygen and the fuel from the jets of said tuyere once the flow of said first and second purging gases has been established,
j. tilting said converter to an approximately horizontal position,
k. reducing the pressure of the purging gases being blown through said tuyere, and
l. removing the refined steel from said converter.

2. The method of operating a tiltable steel refining converter as defined by claim 1 wherein said first gas is selected for the group consisting of compressed air and nitrogen and said second gas is nitrogen.

3. The method as recited in claim 1, comprising the further steps of:

sensing continuously the pressure and flow rates of each of the purging gases, oxygen, and fuel being blown through the center and annulus jets of said tuyere; and automatically supplying substitute gases to said tuyere in the event one or more of said gases, oxygen, or fuel being supplied to any given time falls below a predetermined pressure or flow rate.

4. The method as recited in claim 1 comprising the further steps of:

sensing continuously the pressure and flow rates of each of the gases being blown through the center and annulus jets of said tuyere while the converter is on its side; and preventing the tilting of said converter in Step e. to the upright position if said pressure and flow rates are below a predetermined value.

5. The method as recited in claim 1, comprising the further steps of:

sensing continuously the pressure and flow rates of each of the gases being blown through the center and annulus jets of said tuyere while the converter is on its side;

preventing the tilting of said converter in Step e. to the upright position if said pressure and flow rates are below a predetermined value; and automatically supplying substitute fluids to said tuyere in the event one or more of said purging gases, oxygen, or fuel being supplied at any given time falls below a predetermined pressure or flow rate.

* * * * *